US009259124B2

(12) United States Patent
Wescott, Sr.

(10) Patent No.: US 9,259,124 B2
(45) Date of Patent: Feb. 16, 2016

(54) HANDS-FREE TOILET ADAPTER

(71) Applicant: Reginald E Wescott, Sr., Philadelphia, PA (US)

(72) Inventor: Reginald E Wescott, Sr., Philadelphia, PA (US)

( * ) Notice: Subject to any disclaimer, the term of this patent is extended or adjusted under 35 U.S.C. 154(b) by 310 days.

(21) Appl. No.: 14/043,651

(22) Filed: Oct. 1, 2013

(65) Prior Publication Data

US 2014/0090161 A1 Apr. 3, 2014

Related U.S. Application Data

(60) Provisional application No. 61/708,441, filed on Oct. 1, 2012.

(51) Int. Cl.

| | |
|---|---|
| ***E03D 5/09*** | (2006.01) |
| ***A47K 13/10*** | (2006.01) |
| ***A47K 7/08*** | (2006.01) |
| ***E03D 5/08*** | (2006.01) |

(52) U.S. Cl.

CPC . *A47K 13/10* (2013.01); *A47K 7/08* (2013.01); *E03D 5/08* (2013.01)

(58) Field of Classification Search

CPC ..... A47K 13/10; A47K 7/08; E03D 5/08

USPC ..... 4/405, 411–413, 246.1

See application file for complete search history.

(56) References Cited

U.S. PATENT DOCUMENTS 4,433,442 A * 2/1984 Liou ..... A47K 13/10 4/246.2

7,975,322 B1 * 7/2011 Heller ..... E03D 5/08 4/411

* cited by examiner

*Primary Examiner* — Tuan N Nguyen

(57) ABSTRACT

A toilet adapter which allows a user to lift the lid, the seat, and flush the toilet using three dedicated pedals and their respective actuating mechanisms. The lid pedal and the seat pedal utilize a crankshaft connection to rotate adapters that grasp the lid and the seat, raising the lid and seat as the pedal is pressed. The flush pedal uses a double pivot connection to pull down on an adapter that is secured to a toilet handle. The seat pedal and the flush pedal can be lifted to activate sub assemblies. A bidet assembly and a dryer assembly are operated by lifting the seat pedal and the flush pedal, respectively, with a brace provided so that the regular functions can still be accessed by pressing down. A variation can be implemented for urinals, in which the lid and seat components are unnecessary and left out.

20 Claims, 13 Drawing Sheets

HANDS-FREE TOILET ADAPTER

The current application claims a priority to the U.S. Provisional Patent application Ser. No. 61/708,441 filed on Oct. 1, 2012.

FIELD OF THE INVENTION

The present invention relates generally to toilet accessories. More specifically the present invention is a three pedal toilet adapter which adds functionality to any standard toilet and toilet seat that are currently on the market. The three pedal toilet adapter allows a user to open the lid, open the seat, and flush the toilet all by operating the three different pedals of the three pedal toilet adapter. The toilet adapter also provides foot-operated bidet and dryer systems.

BACKGROUND OF THE INVENTION

Toilets are a cornerstone of human civilization. The toilet allows humans to dispose of bodily waste in a way that is both efficient and sanitary, thus, allowing much higher populations of people to live healthily in a much smaller area than was possible before the advent of the toilet. Although the toilet has greatly improved the sanitation of people relieving themselves, it remains relatively unsanitary by nature of the toilet's intended function; to receive and transport human waste into a septic tank or a sewer system. The presence of a higher concentration of certain bacteria and pathogens, or germs as they are often collectively called, has been a source of some distress for some people. During the course of using a toilet, the user may need to lift either the lid, the seat or both in order to relieve themselves. This situation may be extremely uncomfortable for those people who are concerned about coming into contact with the various bacteria and other pathogens that have a higher saturation in close proximity to toilets. Another major driving factor for a person to lift the seat of the toilet is the common courtesy that the seat should be lifted if a male user intends to urinate in the toilet from the widely used standing position. Although lifting the toilet seat to urinate from a standing position is a widely known and accepted courtesy, some people are too squeamish to touch the toilet seat or in other cases simply too lazy lift to bend down and the seat. In such cases the toilet seat may be subjected to urine coming into contact with the seat; this is a highly undesirable situation as the seat is now contaminated with urine. The contaminated seat is rendered unusable until cleaned thus preventing people from performing bowel movements or other waste disposal activities which require the use of the seat.

It is an object of the present invention to create a device which eliminates the need for a person to touch the lid and the seat of the toilet in order to open them. It is a further object of the present invention to increase the convenience of lifting the lid and the seat of the toilet thus helping to prevent unnecessary contamination of the seat by lazy users who do not take the time to lift the seat. The present invention also may help to prevent the user from having a waste accident as the present invention increases the ease and speed with which the user may open the lid and or seat of the toilet to allow the waste disposal action to be carried out by the user.

DETAIL DESCRIPTIONS OF THE INVENTION

Figure 1:
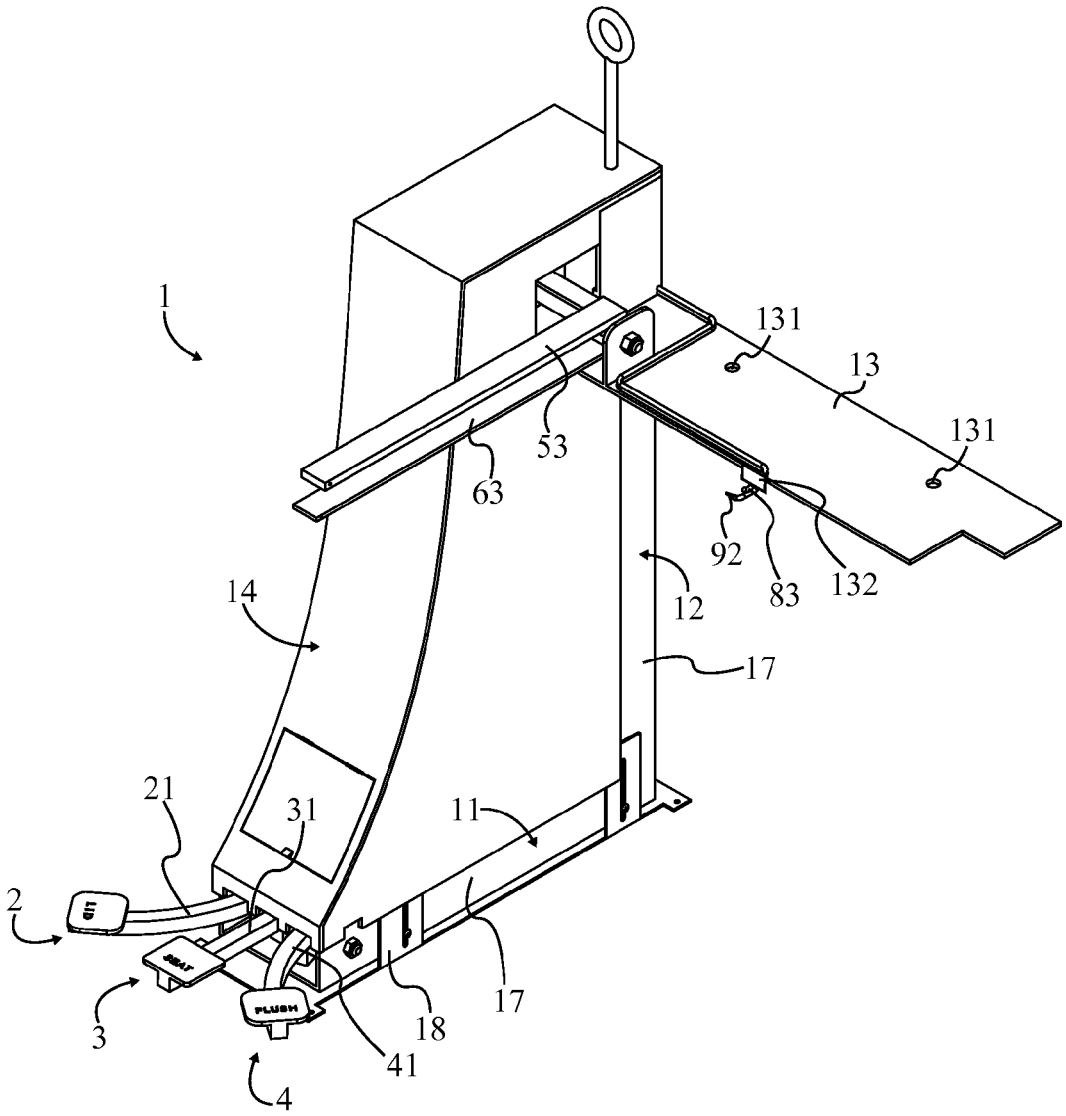
FIG. 1 is a perspective view of the present invention.
Figure 2:
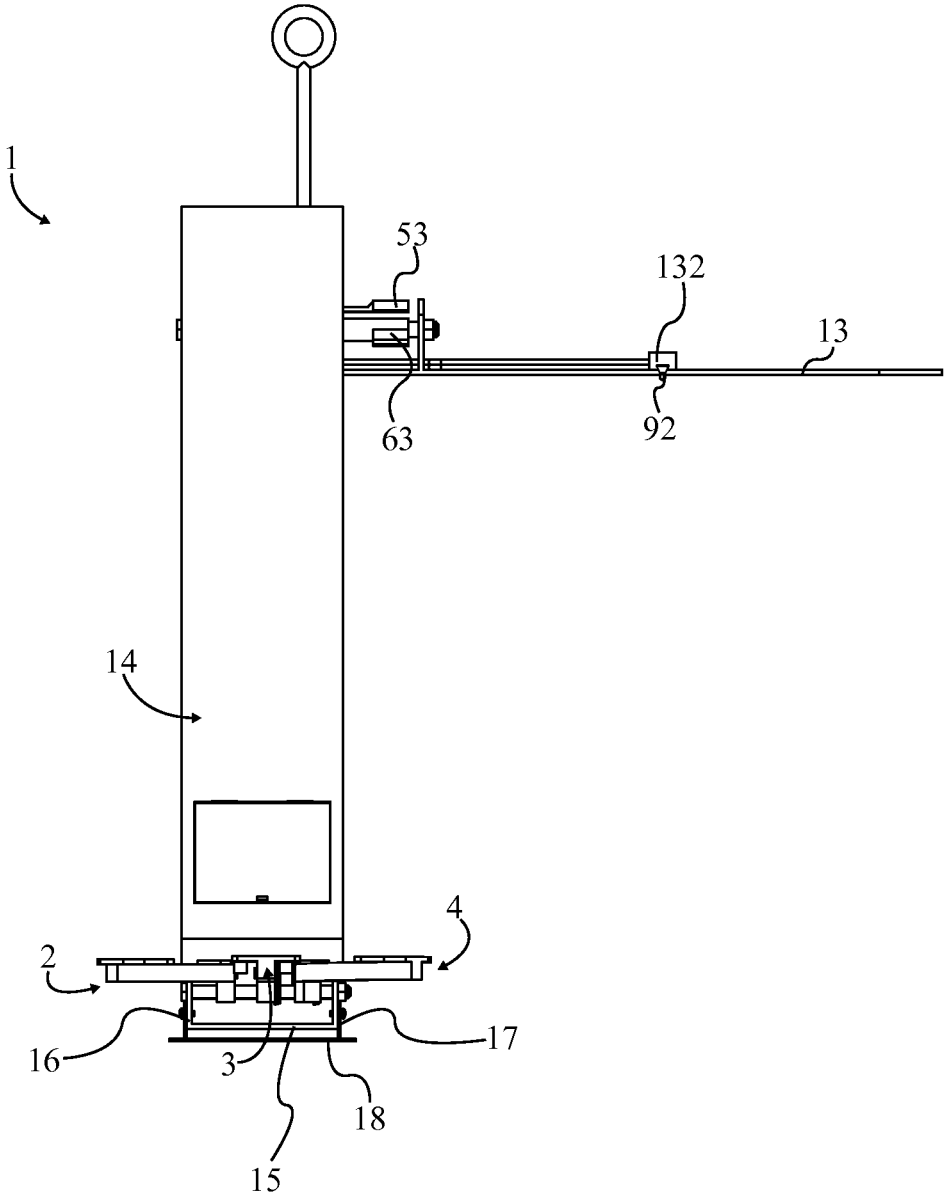
FIG. 2 is a front view of the present invention.
Figure 3:
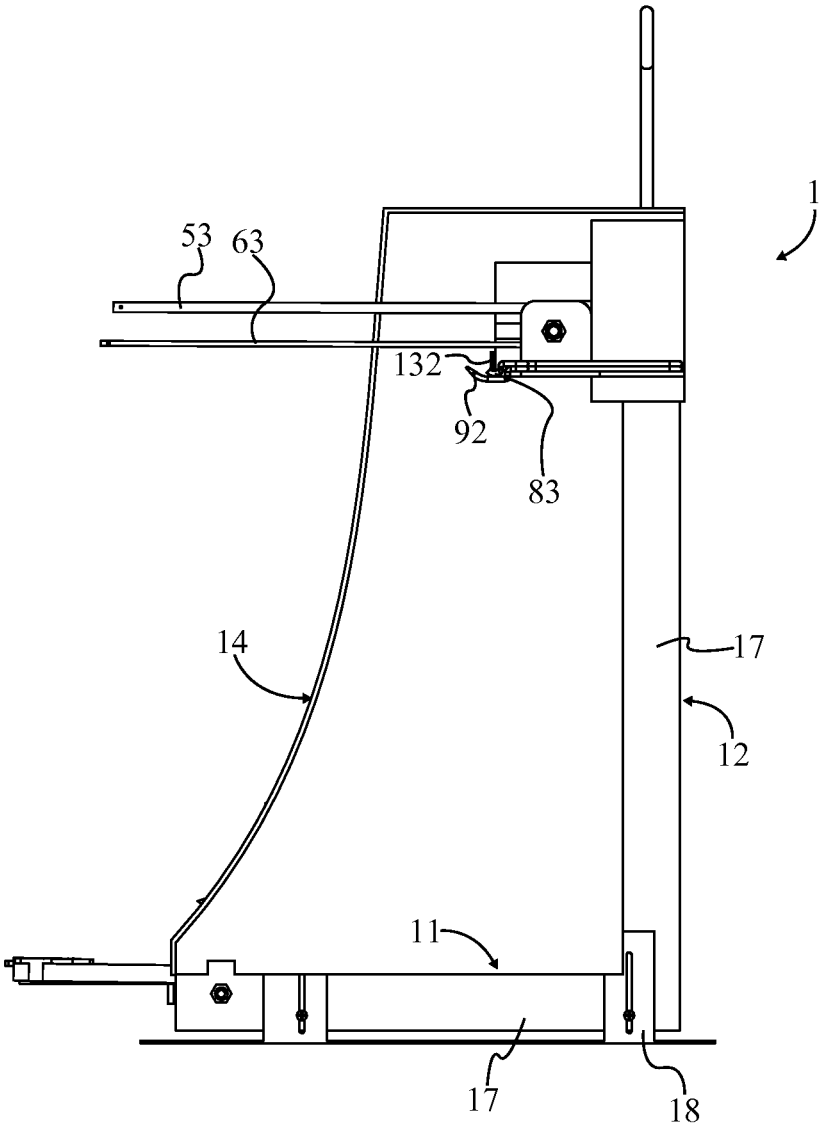
FIG. 3 is a right side view of the present invention.
Figure 4:
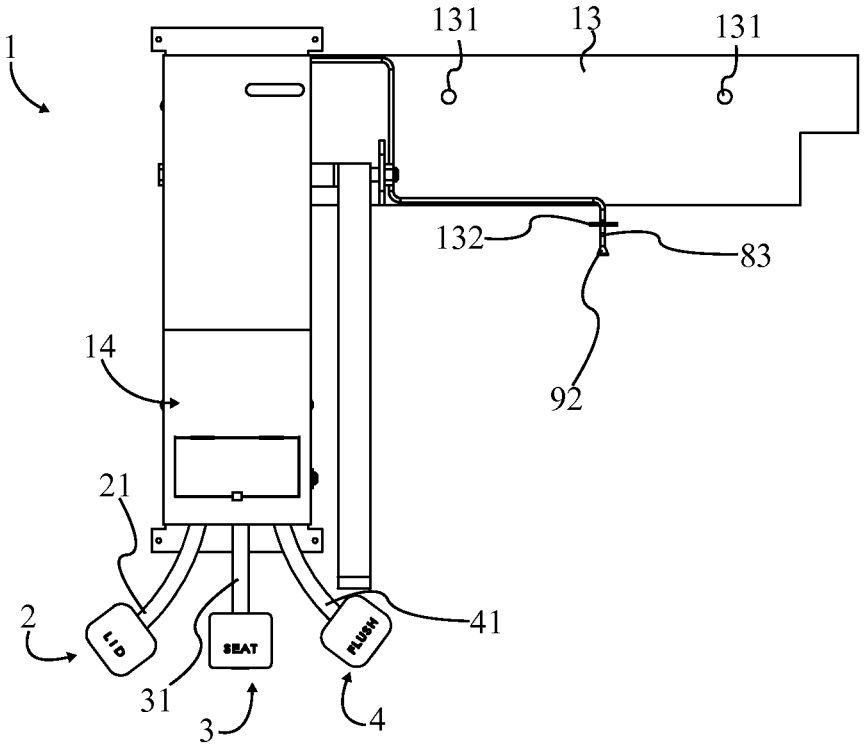
FIG. 4 is a top view of the present invention.
Figure 5:
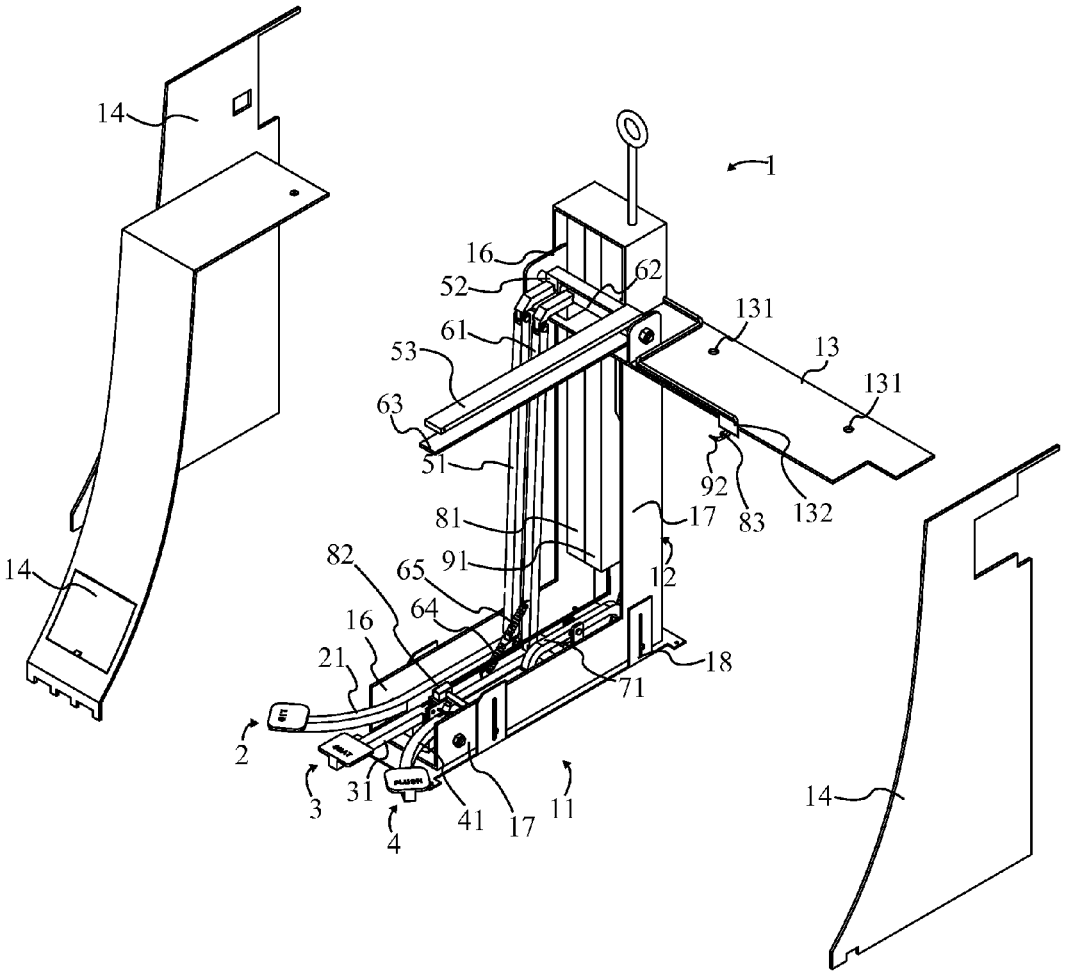
FIG. 5 is a perspective view of the present invention with the cover exploded from the frame.

All illustrations of the drawings are for the purpose of describing selected versions of the present invention and are not intended to limit the scope of the present invention.

The present invention is a three pedal toilet adapter whose purpose is to add functionality to a toilet. More specifically, the present invention is designed to serve as a modification to the toilet that enables a user to open the lid, open the seat, and flush the toilet, all through the use of three pedals which are part of the present invention. The two of the pedals are also used to operate a bidet system which rinses and dries a user's bottom. Overall, the present invention allows for completely hands free operation of a toilet. A complete assembly of the present invention is shown in FIG. 1-FIG. 6.

The present invention comprises a frame 1, a lid pedal 2, a seat pedal 3, a flush pedal 4, a lid actuating mechanism 5, a seat actuating mechanism 6, and a flush actuating mechanism 7, as illustrated in FIG. 7-FIG. 11. The frame 1 houses the components of the present invention, limiting their wear and tear unless necessary. The frame 1 comprises a first c-channel section 11, a second c-channel section 12, and a mounting bracket 13. The first c-channel section 11 and the second c-channel section 12 are connected perpendicular to each other, forming an "L" shape, with the first c-channel section 11 acting as a base and the second c-channel section 12 acting as a back wall. The mounting bracket 13, used to secure the present invention to a toilet, comprises a pair of mounting holes 131. The mounting bracket 13 is oriented perpendicular to both the first c-channel section 11 and the second c-channel section 12, and is connected to the second c-channel section 12. Furthermore, the mounting bracket 13 is hingedly connected, allowing it to be folded down for more compact storage. The pair of mounting holes 131 traverse through the mounting bracket 13, allowing anchors such as screws or bolts to be inserted into a toilet frame through the pair of mounting holes 131. A protective plate 132 is also adjacently and hingedly connected to the mounting bracket 13, provided to prevent fecal matter from entering the spouts (discussed later) of the present invention. Best illustrated in FIG. 7-FIG. 11, the frame 1 further comprises a cover 14, which is connected to the first c-channel section 11 and second c-channel section 12 in order to fully enclose the internal mechanisms of the present invention. The first c-channel section 11 and second c-channel section 12 each comprise a web 15, a first leg 16, and a second leg 17, forming a bracket-shaped profile when viewed along their lengthwise axis. The first leg 16 and the second leg 17 are positioned opposite each other across the web 15, which serves as the main structural element. In order to achieve the desired bracket shape, the first leg 16 and the second flange 17 are connected perpendicular to the web 15, essentially acting as opposing walls in relation to a floor (e.g. the web 15). The position and the connection of the mounting bracket 13 is further defined as being connected perpendicular to the second leg 17 of the second c-channel section 12, such that the mounting bracket 13 extends away from the second c-channel section 12 to a position where it can be anchored to a toilet. Holes are positioned in the frame in the appropriate space to allow the interfaces (specifically the pedals and adapters) of the present invention to be utilized.

The present invention also comprises a height adjustment lift 18, which allows the present invention to be used for varying toilet heights. The height adjustment lift 18 is connected below the frame 1, which can be raised or lowered using the height adjustment lift 18. Visible in FIG. 1-FIG. 11, the height adjustment lift 18 comprises a base and two vertical walls, which are positioned along opposite edges of the base. Each vertical wall comprises a flange and a plurality of vertical tracks. The flanges are positioned opposite the base and adjacent to the vertical wall, such that the height adjustment lift 18 has two flanges. The flanges comprise a plurality of anchor holes which allow the height adjustment lift 18 to be bolted to the floor of the bathroom, providing an additional securing device (the first one being the mounting bracket 13). The frame 1 is slidably engaged with the vertical tracks, allowing the frame 1 to be moved up and down to match the height of a specific toilet. A latching device, such as clamps, can then be used to secure the present invention at the requisite height.

Potentially, in other embodiments, the present invention can be built to match individual toilet specifications, ensuring the proper height by providing a properly sized frame 1 for a given toilet. In such an alternative embodiment, the present invention would not need the height adjustment lift 18, as the present invention would be prebuilt to match a user or manufacturer's specifications.

The lid pedal 2, seat pedal 3, and flush pedal 4 are provided as an interface for a user to operate the lid actuating mechanism 5, the seat actuating mechanism 6, and the flush actuating mechanism 7, respectively. The lid pedal 2 is operatively coupled to the lid actuating mechanism 5, just as the seat pedal 3 is operatively coupled to the seat actuating mechanism 6 and the flush pedal 4 is operatively coupled to the flush actuating mechanism 7. The pedals, through pivot connections, can be pressed to operate the corresponding components of their actuating mechanism. This allows a user to lift a toilet lid, lift a seat lid, or flush the toilet by simply stepping on the associated pedal, providing a hands-free method of operating the toilet.

Figure 6:
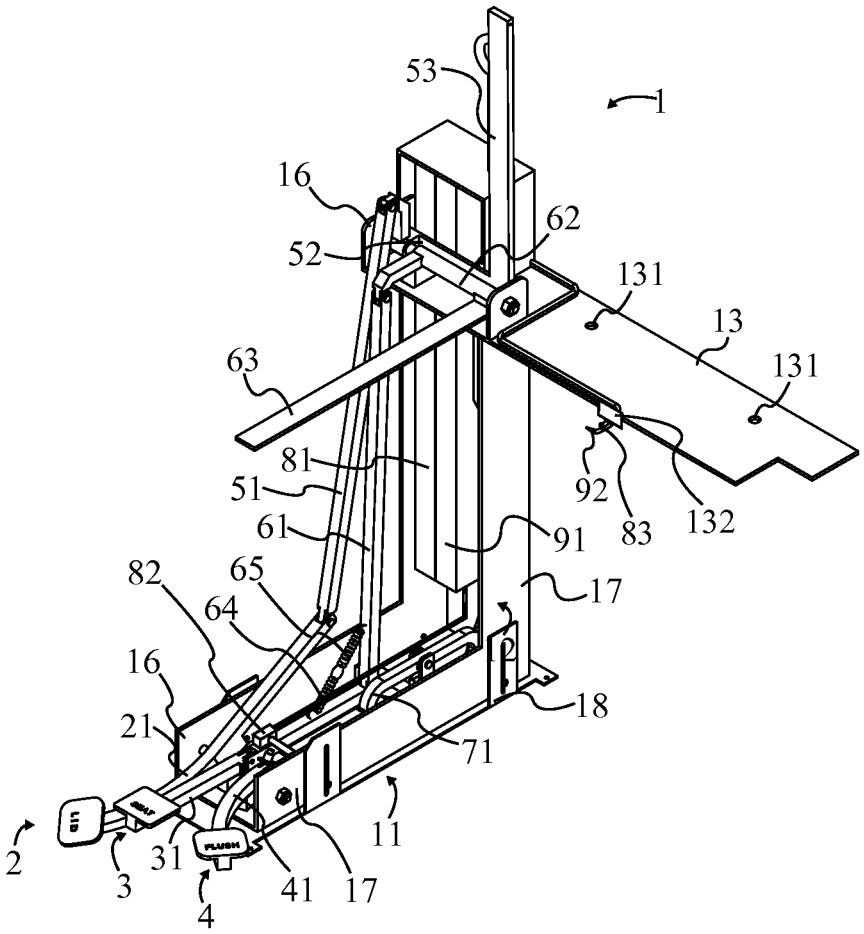
FIG. 6 is a perspective view of the present invention with the cover removed and the lid lift assembly actuated.
Figure 7:
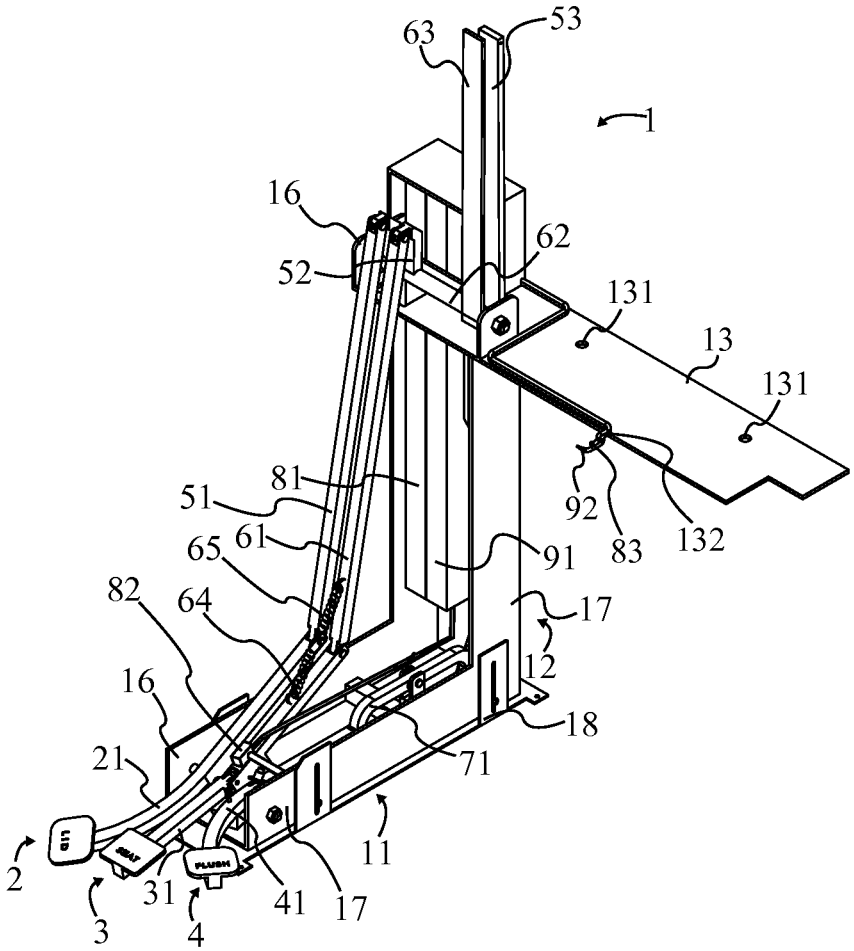
FIG. 7 is a perspective view of the present invention with the cover removed and both the lid lift assembly and the seat lift assembly actuated.

The lid pedal 2 comprises a flush pedal arm 41, while the corresponding lid actuating mechanism 5 comprises a lid connecting rod 51, a lid crankshaft 52, and a lid lifting adapter 53. The lid pedal 2 arm 21 is pivotably and adjacently connected to the lid connecting rod 51. At an end of the lid connecting rod 51 opposite the flush pedal arm 41 is the lid crankshaft 52. The lid connecting rod 51 is pivotably and adjacently connected to this lid crankshaft 52. The connections between the lid pedal 2 arm 21, the lid connecting rod 51, and the lid crankshaft 52 are such that pressing the lid pedal 2 causes the lid pedal 2 arm 21 to push the lid connecting rod 51 up, which causes the connected lid crankshaft 52 to rotate about its axis. More specifically, the lid connecting rod 51 is pivotably connected to a crankpin of the lid crankshaft 52, which allows upwards motion of the lid connecting rod 51 to be translated into rotational motion of the lid crankshaft 52. Axially connected to the lid crankshaft 52 is the lid lifting adapter 53, which rotates along with the lid crankshaft 52. The lid lifting adapter 53 is curved to match the contour of a toilet lid and is positioned opposite the lid connecting rod 51 along the lid crankshaft 52 and adjacent to the mounting bracket 13, where it is fastened to a toilet seat. As the lid crankshaft 52, and subsequently the lid lifting adapter 53, are rotated, the toilet lid is also rotated. Thus, by pressing on the lid pedal 2, a user initiates a sequence of events that result in a toilet seat being lifted, sans the use of hands. To maximize torque, the lid lifting adapter 53 should be sufficiently long that a user can easily lift the lid when pressing on the associated pedal. An example of a pressed lid pedal 2 is shown in FIG. 6 and FIG. 7.

The seat pedal 3 and seat actuating mechanism 6 are functionally equivalent to the lid pedal 2 and actuating pedal, with some minor differences. The seat pedal 3 comprises a seat pedal arm 31 and the seat actuating mechanism 6 comprises a seat connecting rod 61, a seat crankshaft 62, a seat lifting adapter 63, a first spring 64, and a second spring 65. The seat pedal arm 31 is positioned adjacent to and pivotably connected to the seat connecting rod 61. The seat connecting rod 61 is pivotably and adjacently connected to the seat crankshaft 62, opposite the end where the seat pedal arm 31 is located. Axially connected to the seat crankshaft 62 is the seat lifting adapter 63, positioned opposite the seat connecting rod 61 along the seat crankshaft 62. The seat lifting adapter 63 is also defined as being positioned adjacent to the mounting bracket 13, where the seat lifting adapter 63 is fastened to a toilet seat. Additionally, the seat lifting adapter 63 is curved to match the contour of a toilet seat. Similar to the workings of the lid actuating mechanism 5, pressing the seat pedal 3 causes the seat pedal 3 to push the seat connecting rod 61, itself causing rotation of the seat crankshaft 62 and seat lifting adapter 63, and ultimately resulting in the toilet seat being lifted. It is noted that since the lid of a toilet is positioned above the seat, the seat crankshaft 62 and seat lifting adapter 63 must correspondingly be positioned below the lid crankshaft 52 and the lid lifting adapter 53. Two components of the seat actuating mechanism 6 that do not have counterparts in the lid actuating mechanism 5 are the first spring 64 and the second spring 65. The first spring 64 and the second spring 65 are coupled to each other, with the first spring 64 also being coupled to the seat pedal arm 31 and the second spring 65 being coupled to the seat connecting rod 61. The first spring 64 and the second spring 65 are designed to be at a rest state when the seat pedal 3 lid is not pressed, and under tension when the seat pedal 3 is pressed. When under tension, the springs will act to pull the seat connecting rod 61 back down towards the seat pedal arm 31, which would cause the seat lifting adapter 63 to be lowered. Essentially, this design means that the seat will not remain in a lifted position unless a user keeps the seat pedal 3 pressed down. To maximize torque, the seat lifting adapter 63 should be sufficiently long that a user can easily lift the seat when pressing on the associated pedal. An example of a pressed seat pedal 3 is shown in FIG. 7.

The need to keep the seat pedal 3 pressed in order to keep the seat lifted provides a benefit to the present invention, in that a user cannot forget to lower the seat. Since, generally, only men urinate standing up and both sexes sit to defecate, there is an advantage in having the seat actuating mechanism 6 (and resultantly the seat) default to a lowered position. A man can easily keep his foot pressed on the seat pedal 3 while urinating, keeping the seat raised. Once the man is finished, the seat is automatically lowered when the man removes his foot, requiring no additional effort on the man's part. As a result, through use of the present invention, persons will not need to worry about leaving the seat up or down, as it is easily raised with the press of a foot and automatically lowered once the foot is removed.

Figure 8:
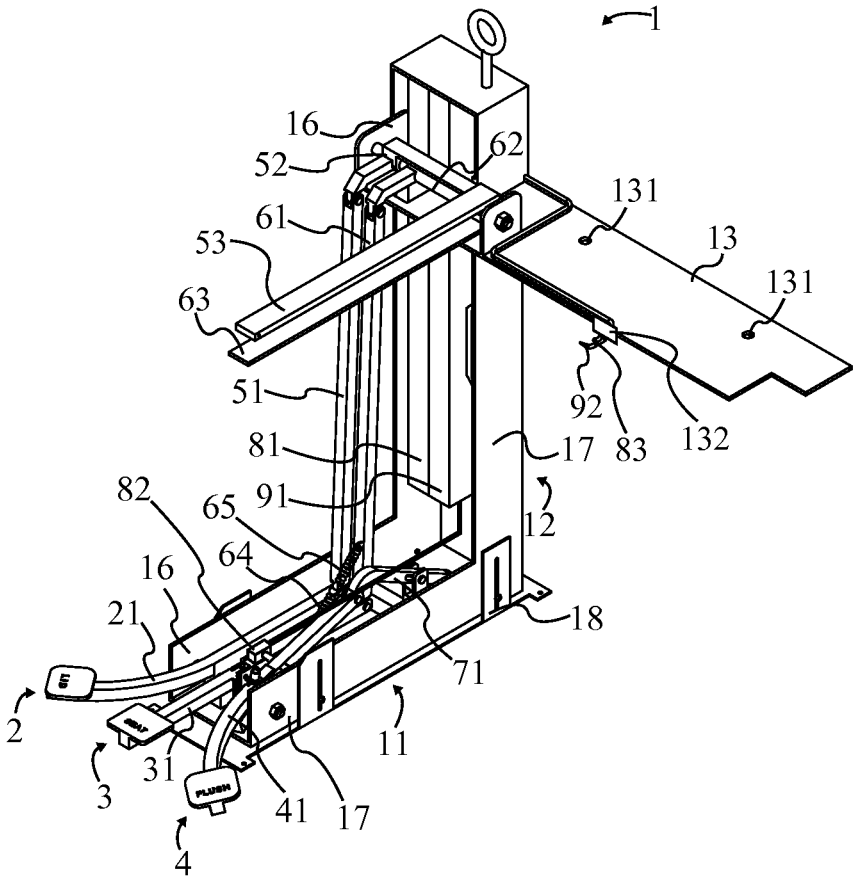
FIG. 8 is a perspective view of the present invention with the flush assembly actuated.

The flush pedal 4 and flush actuating mechanism 7 are designed to allow for hands-free flushing of a toilet, using a combination of pivot connections and rigid structures. The flush pedal 4 comprises a flush pedal arm 41 while the flush actuating mechanism 7 comprises a lever arm 71, a tensile member 72, and a flush adapter 73. The tensile member 72 itself comprises a lower section 74, an upper section 75, and a turn buckle 76. The flush pedal arm 41 is pivotably and adjacently connected to the lever arm 71. Similarly, the lower section 74 of the tensile member 72 is pivotably and adjacently connected to the lever arm 71 opposite the flush pedal arm 41. Visible in FIG. 11, the lower section 74 and upper section 75 are coupled to each other by the turn buckle 76, while a chain 77 is connected to the upper section 75 opposite the turn buckle 76. The flush adapter 73 is then connected to the chain 77 opposite the upper section 75. The flush adapter 73 is designed to engage with a toilet handle, such that when the flush adapter 73 is moved downwards the handle is pulled and the toilet is flushed. The construction of the flush pedal 4 and the flush actuating mechanism 7 is such that pressing on the flush pedal 4 causes the lever arm 71 to pivot. The pivoting lever arm 71 pulls down on the connected tensile member 72, causing the flush adapter 73 to correspondingly pull down on a toilet handle, resulting in the toilet being flushed. Unlike the lid actuating mechanism 5 and the seat actuating mechanism 6, the flush actuating mechanism 7 utilizes an additional pivoting component in the form of the lever. This is because the tensile member 72 needs to move downward in order to pull down on a toilet handle, unlike the lid connecting rod 51 and seat connecting rod 61 which need to move upward to rotate their respective crankshafts. The provision of the lever arm 71 provides the functionality necessary to flush a toilet by pulling on the handle. The turn buckle 76 is provided to allow the present invention to be adjusted for different placements of toilet handles. If a toilet handle is placed high or low compared to the default position of the flush adapter 73, the turn buckle 76 can be used to lower or raise the upper section 75, and thus the connected flush adapter 73. An example of a pressed flush mechanism is shown in FIG. 8. Alternatively, the tensile member 72 can be completely replaced by the chain, which would the connect to the lever arm 71 at one end and the flush adapter 73 at the other end. As with the tensile member 72, the chain 77 is adjustable to accommodate variations in toilet handle heights and positions.

As with the height adjustment lift 18, in other embodiments of the present invention the flush actuating mechanism 7 can be built to match a specific toilet's specifications. Doing so would ensure that the flush adapter 73 is prebuilt to be at the correct height. Resultantly, a turn buckle 76 would not be needed (as the flush adapter's 73 position would not need to be adjusted) and the tensile member 72 could be constructed as a single rigid piece, rather than being separated into an upper section 75 and a lower section 74.

Expanding functionality, the present invention further comprises a bidet assembly 8 and a dryer assembly 9. These assemblies, also foot operated, allow a user to cleanse and dry their rectal and genital areas. The functionality for these assemblies is provided by integrating additional components into the seat pedal 3, seat pedal arm 31, flush pedal 4, and flush pedal arm 41.

Figure 9:
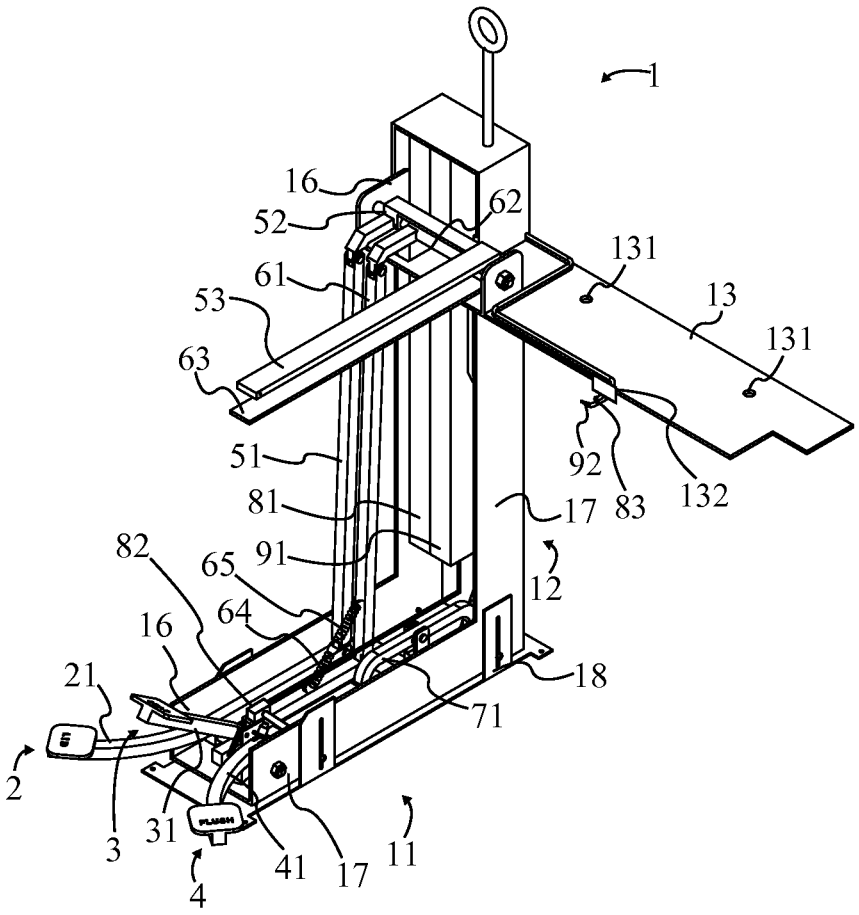
FIG. 9 is a perspective view of the present invention with the bidet system actuated.
Figure 12:
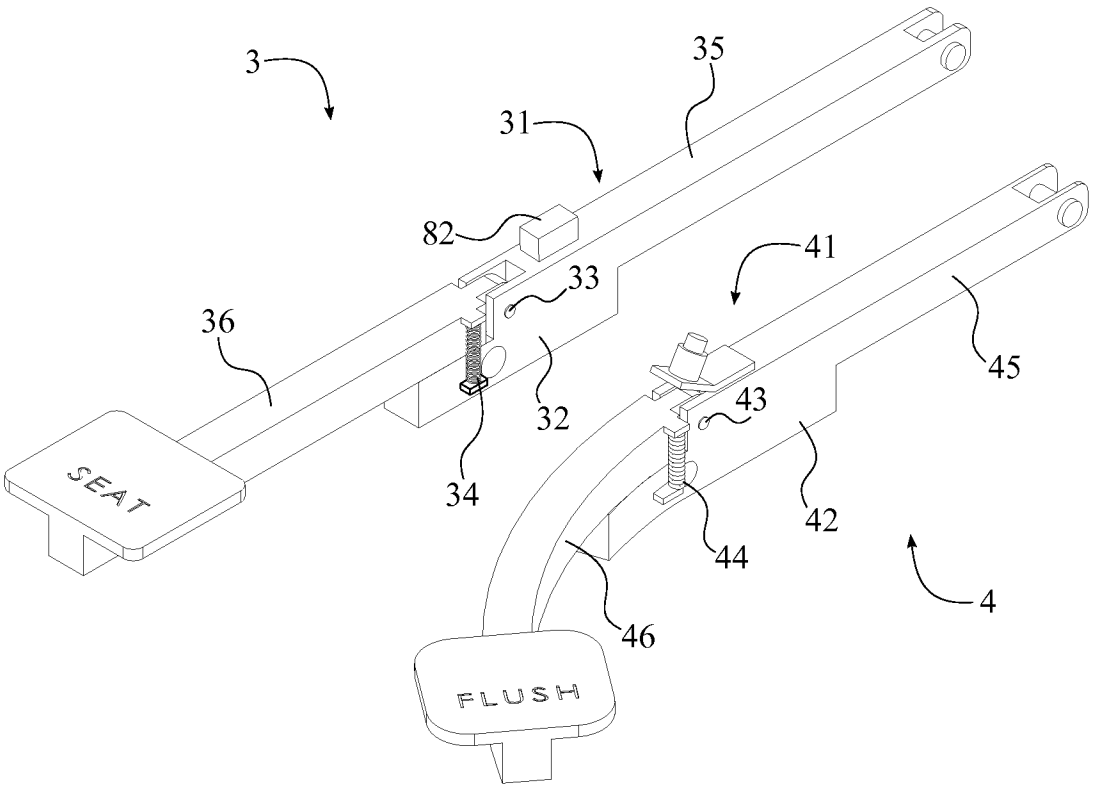
FIG. 12 is a perspective view of the seat pedal and the flush pedal, with other components omitted for ease of disclosure.

The bidet assembly 8 comprises a water heater tank 81, a valve 82, and a fluid dispenser 83. To enable operation of the bidet assembly 8, the seat pedal 3 further comprises a seat pedal brace 32, a seat pedal hinge 33, and a seat pedal spring 34, while the seat pedal arm 31 further comprises a first seat arm section 35 and a second seat arm section 36. The water heater tank 81 is in fluid communication through the fluid dispenser 83 through the valve 82, allowing a user to activate the bidet spray by opening the valve 82. The fluid dispenser 83 is adjacently connected to the mounting bracket 13, where it is positioned to stream water towards a user's rectal area. The valve 82 itself is positioned adjacent to the seat pedal hinge 33, opposite the seat pedal brace 32. The valve 82 is opened by lifting the seat pedal 3 up, as opposed to pushing down on it which operates the seat actuating mechanism 6. To allow part of the seat pedal 3 to be raised by a user, the seat pedal arm 31 is split into the first seat arm section 35 and the second seat arm section 36, which are pivotably connected to each other by the seat pedal hinge 33. The first seat arm section 35 is defined as the one positioned adjacent to the seat connecting rod 61. While the seat pedal hinge 33 allows the seat pedal 3 to be raised, it also adds an extra pivot point to the seat actuating mechanism 6, making the seat actuating mechanism 6 more difficult to operate. To address this, the seat pedal brace 32 is centrally positioned between the first seat arm section 35 and second seat arm section 36, below the seat pedal arm 31 and opposite the seat pedal hinge 33. The seat pedal brace 32 prevents the second arm section from rotating down with respect to the first seat arm section 35, allowing the seat pedal arm 31 to effectively act as a single rigid body when the seat pedal 3 is pressed down. This retains the function of the seat pedal 3 and seat actuating mechanism 6, while providing additional functionality by allowing the second seat arm section 36 to be lifted. As the second seat arm section 36 is lifted, it engages and opens the valve 82, allowing water to flow through the system and out the fluid dispenser 83. In this manner, a user can utilize the bidet assembly 8 of the present invention to rinse their rectal area by simply lifting their foot to raise the seat pedal 3. In order to automatically shut the valve 82 when not in use, the seat pedal spring 34 is connected between the second seat arm section 36 and the seat pedal brace 32. The seat pedal spring 34 pulls the second seat arm section 36 back towards a parallel position with the first seat arm section 35, in which the valve 82 is closed. Thus, the valve 82 defaults to a closed configuration. An example of a raised seat pedal 3 is shown in FIG. 9, while the springs are visible in FIG. 12 and the water heater tank 81 is visible in FIG. 11.

Figure 10:
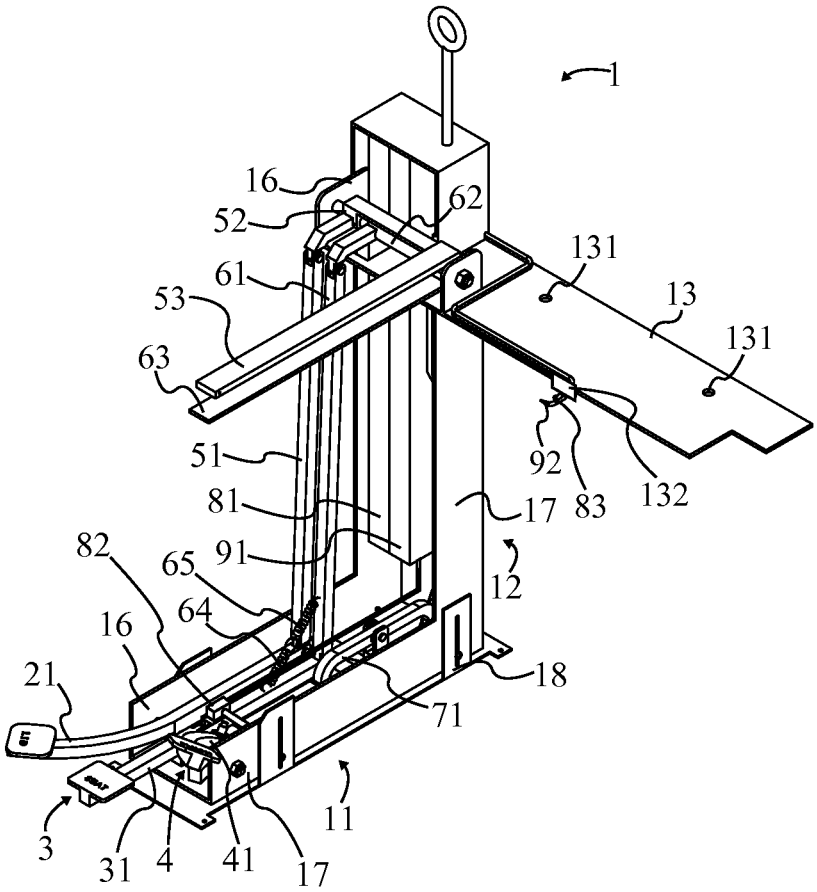
FIG. 10 is a perspective view of the present invention with the dryer system actuated.
Figure 11:
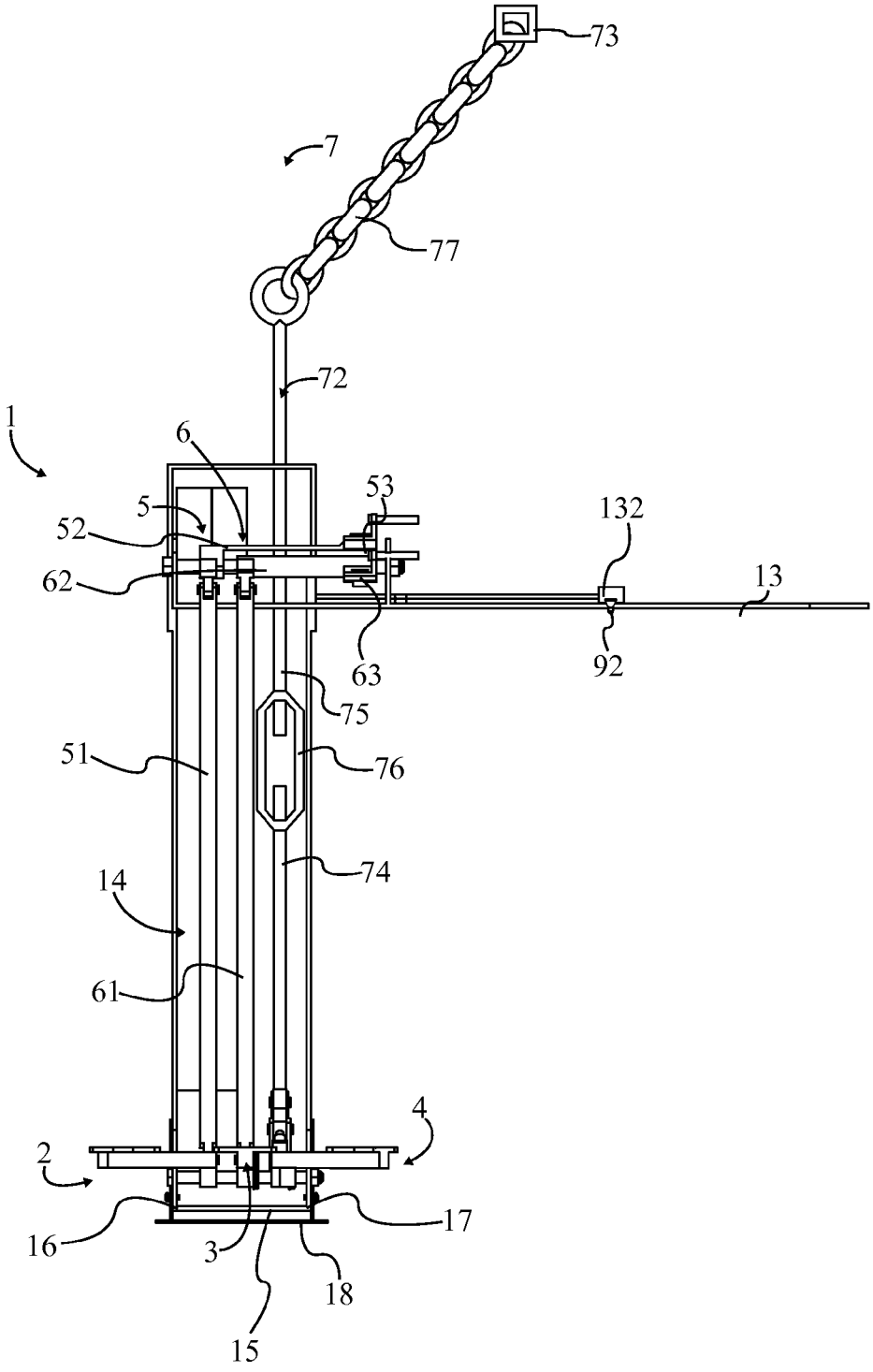
FIG. 11 is a front view of the present invention, with cover omitted for ease of disclosure.

Just as the bidet assembly 8 is operated using the seat pedal 3, the dryer assembly 9 is operated using the flush pedal 4. The dryer assembly 9 itself comprises an air heater tank 91, a dryer head 92, and a power switch 93, while the flush pedal 4 further comprises a flush pedal brace 42, a flush pedal hinge 43, and a flush pedal spring 44. The flush pedal arm 41 further comprises a first flush arm section 45 and a second flush arm section 46. The additional components of the flush pedal 4 minor the positioning and relations of their counterparts in the seat pedal 3. The dryer head 92 is adjacently connected to the mounting bracket 13, oriented to exhaust air towards a user's rectal area. The first flush arm section 45 is positioned adjacent to the tensile member 72, and is pivotably connected to the second flush arm section 46 by the flush pedal hinge 43. This connection allows the second flush arm to be raised in order to activate the dryer assembly 9. To prevent the second flush arm from rotating when being pushed down (as done when operating the flush actuating mechanism 7), the brace is positioned at the bottom part of the flush pedal arm 41, between the first flush arm section 45 and the second flush arm section 46, adjacent to the flush pedal hinge 43. The power switch 93 is positioned adjacent to the flush pedal hinge 43 opposite the flush pedal brace 42, such that it is engaged by the second flush arm section 46 when flush pedal 4 is lifted by a user. As a user lifts the flush pedal 4, the second flush arm section 46 rotates about the flush pedal hinge 43 until it hits the power switch 93. As a result, the power switch 93 is engaged, activating the dryer assembly 9. The air expelled from the dryer head 92 originates from the air heater tank 91, which the dryer head 92 is in fluid communication with. The power switch 93 is electrically connected to the dryer head 92, allowing the power switch 93 to turn the dryer head 92 on or off. Similar to the seat pedal spring 34, the flush pedal spring 44 is connected between the second flush arm section 46 and the flush pedal brace 42. This pulls the second flush arm section 46 to a position parallel with the first flush arm section 45, in which the power switch 93 is disengaged. Resultantly, the dryer head 92 will automatically shutoff once a user stops lifting the flush pedal hinge 43 with their foot. An example of a raised flush pedal 4 is shown in FIG. 10, while the springs are visible in FIG. 12 and the air heater tank 91 is visible in FIG. 11.

The protective plate 132 is positioned adjacent to the mounting bracket 13, and positioned such that it covers the openings of the fluid dispenser 83 and the dryer head 92. In this manner, the protective plate 132 prevents fecal matter and general debris from entering the pipes for the bidet assembly 8 and the dryer assembly 9 while a user is defecating. The protective plate 132 is hingedly connected to the mounting bracket 13, such that it can be rotated open by water or air being expelled from the fluid dispenser 83 or dryer head 92, respectively. The protective plate 132 then swings back to a default closed position once the water or air stops flowing.

Allowing a user to access the internal components of the present invention, a hood is hingedly connected to the front part of the cover 14, while a hinged access door is connected to the rear. The hood comprises an externally mounted illumination source (specifically a light emitting diode or LED), which is motion activated and lights up the pedals when a user's foot is detected. Inside the hood, a power source is provide for the LED. The power source (e.g. batteries), as well as the valve 82, tubes, and piping for the bidet assembly 8 and dryer assembly 9 can be accessed. Potentially, an externally mounted solar power panel can be used as the power source for the LED. The access door allows a user to access the water heater tank 81 and the air heater tank 91. In the preferred embodiment, the water heater tank 81 and the air heater tank 91 are filtered, such that only clean air and water is used to rinse and dry a user's rectal area. The tubes and piping used as part of the bidet assembly 8 and dryer assembly 9 are adjustable, allowing them to be repositioned for variations in toilet arrangements and designs.

Figure 13:
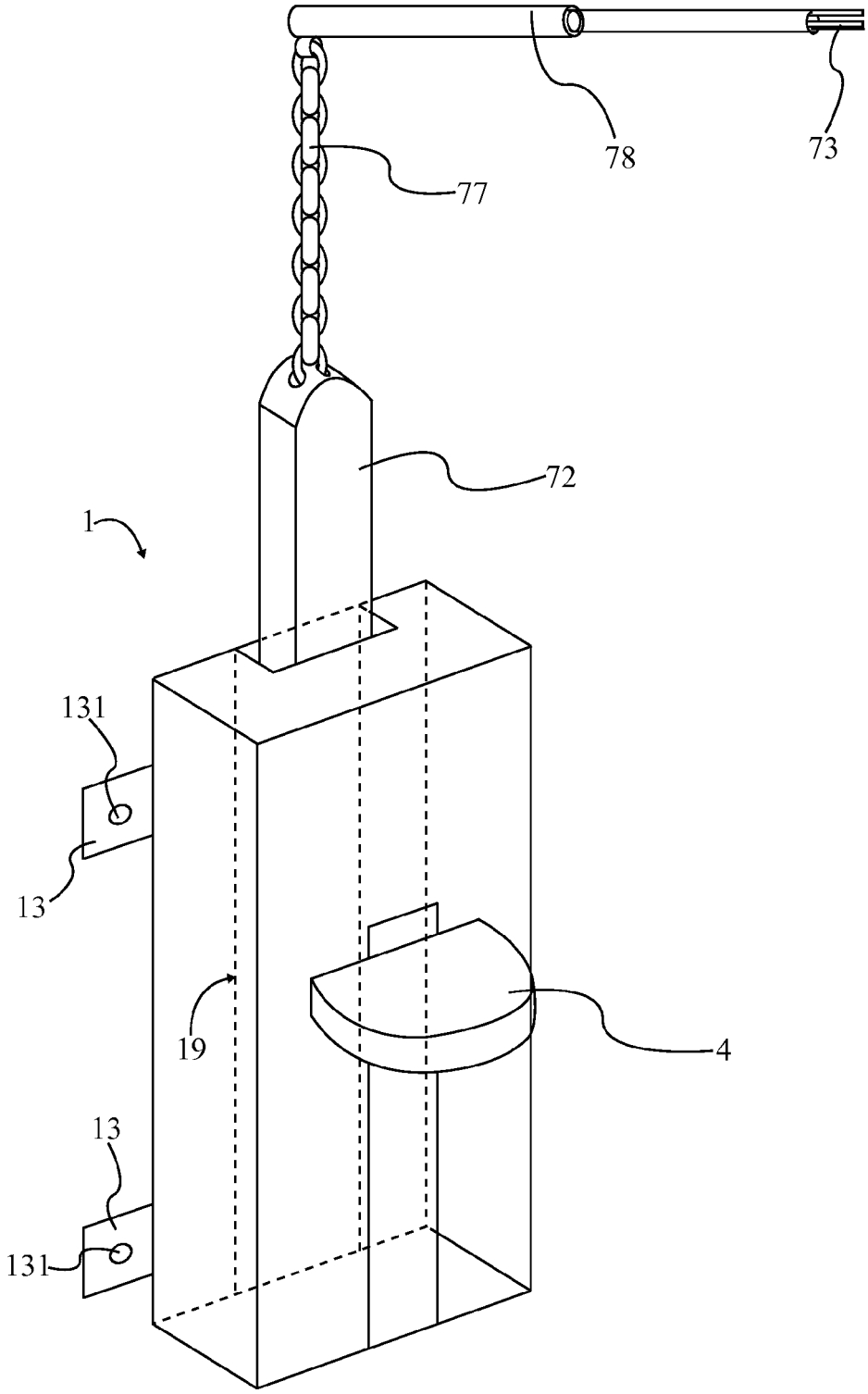
FIG. 13 is a perspective view of a variant urinal embodiment of the present invention.

In another embodiment, shown in FIG. 13, the present invention can be adapted to fit a urinal rather than a regular flush toilet. Because a urinal does not have a seat or lid, the present invention can be simplified for use with a urinal, although some adjustments are required. The urinal embodiment of the present invention comprises a frame 1, a flush pedal 4, and flush actuating mechanism 7. The frame 1 comprises a first c-channel section 11 and a plurality of mounting brackets 13. The frame 1 houses the flush actuating mechanism 7 and the flush pedal 4, and allows the invention to be securely mounted to a wall or floor.

The first c-channel section 11 comprises a web 15, a first leg 16, a second leg 17, and a track 19. The first leg 16 and the second leg 17 form the sides of the frame 1, while the web 15 forms the back of the frame 1. Thus, the first leg 16 and the second leg 17 are positioned opposite each other across the web 15, to which they are perpendicularly connected. The track 19, which interacts with the flush actuating mechanism 7, is vertically oriented and positioned along the web 15. The frame 1 further comprises a cover 14, which is used to help enclose the components housed within the frame 1. The cover 14 is adjacently connected to the first c-channel section 11, forming a front face of the frame 1.

Securing the frame 1 in place is the plurality of mounting brackets 13, each of which comprise a mounting hole 131 designed to receive a fastener or other anchoring device. The plurality of mounting brackets 13 are positioned around the perimeter of the frame 1, which they are connected to. The plurality of mounting brackets 13 are oriented to be parallel to and coplanar with the web 15, such that they can be positioned flush with a wall. In another variation, the plurality of mounting brackets 13 could instead be oriented to be perpendicular to the web 15, the first leg 16, and the second leg 17, such that they can be positioned flush with a floor. During construction, the plurality of mounting bracket 13s could be molded with the frame 1, acting as flanges to the first leg 16 and the second leg 17.

Ideally, there are four mounting brackets 13, two mounting brackets 13 being connected to the first leg 16 and two mounting brackets 13 being connected to the second leg 17. The mounting brackets 13 are positioned flush with a wall, allowing fasteners to be inserted through the mounting holes 131 and thus securing the frame 1 to a wall.

The flush pedal 4 comprises a flush pedal arm 41, while the flush actuating mechanism 7 comprises a tensile member 72, a chain 77, a telescoping extension arm 78, and a flush adapter 73. The flush pedal arm 41 is connected perpendicular to the tensile member 72, allowing a user to press down on the flush pedal 4 to lower the tensile member 72. The tensile member 72 itself is slidably engaged with the track 19, allowing the tensile member 72 to move vertically with respect to the web 15. Opposite the flush pedal arm 41, the chain 77 is adjacently connected to the tensile member 72. The chain 77 is of a sufficient height that its free end is coincident with the handle of a urinal. Since urinal handles are often over the center area of the urinal, the telescoping extension arm 78 is provided. The telescoping extension arm 78 is adjacently connected to the chain 77 opposite the tensile member 72, and is oriented perpendicular to the second leg 17. Effectively, the telescoping extension arm 78 is coincident with the handle of a urinal. Designed to engage with the urinal handle, the flush adapter 73 is adjacently connected to the telescoping extension arm 78 opposite the chain 77. Preferably, a clamp is provided to couple the urinal handle with the flush adapter 73, though other methods of coupling may be used instead.

The urinal variation works by having a user press down on the flush pedal 4. The flush pedal 4 and flush pedal 4 are force the tensile member 72 to move down along the track 19, which in turn lowers the chain 77. As the chain 77 is lowered, it pulls down on one end of the telescoping extension arm 78. Subsequently, the other end of the telescoping extension arm 78 pulls down on the urinal handle and creates sufficient torque to flush the urinal. Thus, the present invention can not only be used with a standard flush toilet, but is also adaptable for use with a urinal.

Although the invention has been explained in relation to its preferred embodiment, it is to be understood that many other possible modifications and variations can be made without departing from the spirit and scope of the invention as hereinafter claimed.

What is claimed is:

1. A hands-free toilet adapter comprises:

a frame;

the frame comprises a first c-channel section, a second c-channel section, and a mounting bracket;

a lid pedal;

a seat pedal;

a flush pedal;

the lid pedal comprises a lid pedal arm;

the seat pedal comprises a seat pedal arm;

the flush pedal comprises a flush pedal arm;

a lid actuating mechanism;

a seat actuating mechanism;

a flush actuating mechanism;

the lid actuating mechanism being operatively coupled the lid pedal;

the seat actuating mechanism being operatively coupled the seat pedal;

the flush actuating mechanism being operatively coupled the flush pedal;

the lid actuating mechanism comprises a lid connecting rod, a lid crankshaft, and a lid lifting adapter;

the seat actuating mechanism comprises a seat connecting rod, a seat crankshaft, and a seat lifting adapter;

the flush actuating mechanism comprises a lever arm, a tensile member, and a flush adapter; and the lid actuating mechanism, the seat actuating mechanism, and the flush actuating mechanism being housed in the frame.

2. The hands-free toilet adapter as claimed in claim 1 further comprises:

a protective plate;

the mounting bracket comprises a pair of mounting holes;

the first c-channel section and the second c-channel section being connected perpendicular to each other;

the mounting bracket being perpendicular to the first c-channel section and the second c-channel section;

the mounting bracket being connected to the second c-channel section;

the pair of mounting holes traversing through the mounting bracket;

the protective plate being positioned adjacent to the mounting bracket; and the protective plate being hingedly connected to the mounting bracket.

3. The hands-free toilet adapter as claimed in claim 2 further comprises:

the frame further comprises a cover;

the cover being adjacently connected to the first c-channel section and the second c-channel section;

the first c-channel section and the second c-channel section each comprise a web, a first leg, and a second leg;

the first leg and the second leg being positioned opposite each other across the web;

the first leg and the second leg being connected perpendicular to the web; and the mounting bracket being positioned adjacent to the second leg of the second c-channel section.

4. The hands-free toilet adapter as claimed in claim 1 further comprises:

a height adjustment lift; and the height adjustment lift being connected below the frame.

5. The hands-free toilet adapter as claimed in claim 1 further comprises:

the lid pedal arm being pivotably and adjacently connected to the lid connecting rod;

the lid connecting rod being pivotably and adjacently connected to the lid crankshaft opposite the lid pedal arm;

the lid lifting adapter being positioned opposite the lid connecting rod along the lid crankshaft;

the lid lifting adapter being axially connected to the lid crankshaft; and the lid lifting adapter being positioned adjacent to the mounting bracket.

6. The hands-free toilet adapter as claimed in claim 1 further comprises:

the seat actuating mechanism further comprises a first spring and a second spring;

the seat pedal arm being pivotably and adjacently connected to the seat connecting rod;

the seat connecting rod being pivotably and adjacently connected to the seat crankshaft opposite the seat pedal arm;

the seat lifting adapter being positioned opposite the seat connecting rod along the seat crankshaft;

the seat lifting adapter being axially connected to the seat crankshaft;

the seat lifting adapter being positioned between the lid lifting adapter and the mounting bracket;

the first spring being coupled to the seat pedal arm;

the second spring being coupled to the seat connecting rod; and the first spring and the second spring being coupled to each other.

7. The hands-free toilet adapter as claimed in claim 1 further comprises:

a chain;

the tensile member comprises a lower section, an upper section, and a turn buckle;

the flush pedal arm being pivotably and adjacently connected to the lever arm;

the lower section being pivotably connected to the lever arm opposite the flush pedal arm;

the lower section being coupled to the upper section by the turn buckle;

the chain being adjacently connected to the upper section opposite the turn buckle; and the flush adapter being adjacently connected to the chain opposite the upper section.

8. The hands-free toilet adapter as claimed in claim 1 further comprises:

a bidet assembly;

the bidet assembly comprises a water heater tank, a valve, and a fluid dispenser;

the seat pedal further comprises a seat pedal brace, a seat pedal hinge and a seat pedal spring;

the seat pedal arm further comprises a first seat arm section and a second seat arm section;

the seat pedal brace being centrally positioned between the first seat arm section and the second seat arm section;

the first seat arm section being positioned adjacent to the seat connecting rod;

the seat pedal hinge being positioned adjacent to the seat pedal brace;

the valve being positioned adjacent to the seat pedal hinge opposite the seat pedal brace;

the seat pedal brace and the valve being connected to the first seat arm section;

the first seat arm section and the second seat arm section being pivotably connected to each other by the seat pedal hinge;

the valve being selectively engaged by the second seat arm section;

the seat pedal spring being connected between the second seat arm section and the seat pedal brace;

the fluid dispenser being adjacently connected to the mounting bracket; and the water heater tank being in fluid communication with the fluid dispenser through the valve.

9. The hands-free toilet adapter as claimed in claim 1 further comprises:

a dryer assembly;

the dryer assembly comprises an air heater tank, a dryer head, and a power switch;

the flush pedal further comprises a flush pedal brace, a flush pedal hinge, and a flush pedal spring;

the flush pedal arm further comprises a first flush arm section and a second flush arm section;

the flush pedal brace being centrally positioned between the first flush arm section and the second flush arm section;

the first flush arm section being positioned adjacent to the tensile member;

the flush pedal hinge being positioned adjacent to the flush pedal brace;

the power switch being positioned adjacent to the flush pedal hinge opposite the flush pedal brace;

the flush pedal brace and the power switch being connected to the first flush arm section;

the first flush arm section and the second flush arm section being pivotably connected to each other by the flush pedal hinge;

the power switch being selectively engaged by the second flush arm section;

the flush pedal spring being connected between the second flush arm section and the flush pedal brace;

the dryer head being adjacently connected to the mounting bracket;

the dryer head being in fluid communication with the air heater tank; and the power switch being electrically connected to the dryer head.

10. A hands-free toilet adapter comprises:

a frame;

the frame comprises a first c-channel section, a second c-channel section, and a mounting bracket;

a height adjustment lift;

the height adjustment lift being connected below the frame;

a lid pedal;

a seat pedal;

a flush pedal;

the lid pedal comprises a lid pedal arm;

the seat pedal comprises a seat pedal arm;

the flush pedal comprises a flush pedal arm;

a lid actuating mechanism;

a seat actuating mechanism;

a flush actuating mechanism;

the lid actuating mechanism being operatively coupled the lid pedal;

the seat actuating mechanism being operatively coupled the seat pedal;

the flush actuating mechanism being operatively coupled the flush pedal;

the lid actuating mechanism comprises a lid connecting rod, a lid crankshaft, and a lid lifting adapter;

the seat actuating mechanism comprises a seat connecting rod, a seat crankshaft, and a seat lifting adapter;

the flush actuating mechanism comprises a lever arm, a tensile member, and a flush adapter;

the lid pedal arm being pivotably and adjacently connected to the lid connecting rod;

the seat pedal arm being pivotably and adjacently connected to the seat connecting rod;

the flush pedal arm being pivotably and adjacently connected to the lever arm; and the lid actuating mechanism, the seat actuating mechanism, and the flush actuating mechanism being housed in the frame.

11. The hands-free toilet adapter as claimed in claim 10 further comprises:

a protective plate;

the mounting bracket comprises a pair of mounting holes;

the frame further comprises a cover;

the first c-channel section and the second c-channel section being connected perpendicular to each other;

the mounting bracket being perpendicular to the first c-channel section and the second c-channel section;

the mounting bracket being connected to the second c-channel section;

the pair of mounting holes traversing through the mounting bracket;

the protective plate being positioned adjacent to the mounting bracket;

the protective plate being hingedly connected to the mounting bracket;

the cover being adjacently connected to the first c-channel section and the second c-channel section;

the first c-channel section and the second c-channel section each comprise a web, a first leg, and a second leg;

the first leg and the second leg being positioned opposite each other across the web;

the first leg and the second leg being connected perpendicular to the web; and the mounting bracket being positioned adjacent to the second leg of the second c-channel section.

12. The hands-free toilet adapter as claimed in claim 10 further comprises:

the lid connecting rod being pivotably and adjacently connected to the lid crankshaft opposite the lid pedal arm;

the lid lifting adapter being positioned opposite the lid connecting rod along the lid crankshaft;

the lid lifting adapter being axially connected to the lid crankshaft;

the lid lifting adapter being positioned adjacent to the mounting bracket.

13. The hands-free toilet adapter as claimed in claim 10 further comprises:

the seat actuating mechanism further comprises a first spring and a second spring;

the seat connecting rod being pivotably and adjacently connected to the seat crankshaft opposite the seat pedal arm;

the seat lifting adapter being positioned opposite the seat connecting rod along the seat crankshaft;

the seat lifting adapter being axially connected to the seat crankshaft;

the seat lifting adapter being positioned between the lid lifting adapter and the mounting bracket;

the first spring being coupled to the seat pedal arm;

the second spring being coupled to the seat connecting rod; and the first spring and the second spring being coupled to each other.

14. The hands-free toilet adapter as claimed in claim 10 further comprises:

a chain;

the tensile member comprises a lower section, an upper section, and a turn buckle;

the lower section being pivotably connected to the lever arm opposite the flush pedal arm;

the lower section being coupled to the upper section by the turn buckle;

the chain being adjacently connected to the upper section opposite the turn buckle; and the flush adapter being adjacently connected to the chain opposite the upper section.

15. The hands-free toilet adapter as claimed in claim 10 further comprises:

a bidet assembly;

the bidet assembly comprises a water heater tank, a valve, and a fluid dispenser;

the seat pedal further comprises a seat pedal brace, a seat pedal hinge and a seat pedal spring;

the seat pedal arm further comprises a first seat arm section and a second seat arm section;

the seat pedal brace being centrally positioned between the first seat arm section and the second seat arm section;

the first seat arm section being positioned adjacent to the seat connecting rod;

the seat pedal hinge being positioned adjacent to the seat pedal brace;

the valve being positioned adjacent to the seat pedal hinge opposite the seat pedal brace;

the seat pedal brace and the valve being connected to the first seat arm section;

the first seat arm section and the second seat arm section being pivotably connected to each other by the seat pedal hinge;

the valve being selectively engaged by the second seat arm section;

the seat pedal spring being connected between the second seat arm section and the seat pedal brace;

the fluid dispenser being adjacently connected to the mounting bracket; and the water heater tank being in fluid communication with the fluid dispenser through the valve.

16. The hands-free toilet adapter as claimed in claim 10 further comprises:

a dryer assembly;

the dryer assembly comprises an air heater tank, a dryer head, and a power switch;

the flush pedal further comprises a flush pedal brace, a flush pedal hinge, and a flush pedal spring;

the flush pedal arm further comprises a first flush arm section and a second flush arm section;

the flush pedal brace being centrally positioned between the first flush arm section and the second flush arm section;

the first flush arm section being positioned adjacent to the tensile member;

the flush pedal hinge being positioned adjacent to the flush pedal brace;

the power switch being positioned adjacent to the flush pedal hinge opposite the flush pedal brace;

the flush pedal brace and the power switch being connected to the first flush arm section;

the first flush arm section and the second flush arm section being pivotably connected to each other by the flush pedal hinge;

the power switch being selectively engaged by the second flush arm section;

the flush pedal spring being connected between the second flush arm section and the flush pedal brace;

the dryer head being adjacently connected to the mounting bracket;

the dryer head being in fluid communication with the air heater tank; and the power switch being electrically connected to the dryer head.

17. A hands-free toilet adapter comprises:

a frame;

the frame comprises a first c-channel section and a plurality of mounting brackets;

the first c-channel section comprises a web, a first leg, a second leg, and a track;

a flush pedal;

the flush pedal comprises a flush pedal arm;

a flush actuating mechanism;

the flush actuating mechanism being operatively coupled the flush pedal;

the flush actuating mechanism comprises a tensile member, a chain, a telescoping extension arm, and a flush adapter; and the tensile member being housed in the frame.

18. The hands-free toilet adapter as claimed in claim 17 further comprises:

the frame further comprises a cover;

the cover being adjacently connected to the first c-channel section;

the first leg and the second leg being positioned opposite each other across the web;

the first leg and the second leg being connected perpendicular to the web; and the track being positioned along the web.

19. The hands-free toilet adapter as claimed in claim 17 further comprises the plurality of mounting brackets being parallel to the web;

the plurality of mounting brackets being perimetrically connected to the frame; and each of the plurality of mounting brackets comprises a mounting hole.

20. The hands-free toilet adapter as claimed in claim 17 further comprises:

the flush pedal arm being connected perpendicular to the tensile member;

the tensile member being slidably engaged with the track;

the chain being adjacently connected to the tensile member opposite the flush pedal arm;

the telescoping extension arm being adjacently connected to the chain opposite the tensile member;

the telescoping extension arm being perpendicular to the second leg; and the flush adapter being adjacently connected to the telescoping extension arm opposite the chain.

* * * * *